US008857638B2

(12) United States Patent
Brozell

(10) Patent No.: US 8,857,638 B2
(45) Date of Patent: Oct. 14, 2014

(54) PUSH-AND-TURN CHILD-RESISTANT CLOSURE, SHELLS, AND PACKAGE

(75) Inventor: Brian John Brozell, Maumee, OH (US)

(73) Assignee: BPRex Healthcare Packaging Inc., Perrysburg, OH (US)

( * ) Notice: Subject to any disclaimer, the term of this patent is extended or adjusted under 35 U.S.C. 154(b) by 847 days.

(21) Appl. No.: 12/959,509

(22) Filed: Dec. 3, 2010

(65) Prior Publication Data

US 2012/0138561 A1 Jun. 7, 2012

(51) Int. Cl.

| | |
|---|---|
| ***B65D 35/44*** | (2006.01) |
| ***B65D 50/04*** | (2006.01) |
| *B65D 50/06* | (2006.01) |

(52) U.S. Cl.

CPC ..... *B65D 50/041* (2013.01); *B65D 50/06* (2013.01); *B65D 50/043* (2013.01)

USPC ..... 215/220; 215/219; 215/329; 215/356; 220/259.4; 220/259.5; 220/254.7; 220/255; 220/780

(58) Field of Classification Search

CPC ..... B65D 50/041; B65D 50/043; B65D 50/06

USPC ..... 215/220, 201, 217, 219, 329, 44, 356; 220/256.1, 258.1, 254.3, 259.4, 259.5, 220/254, 254.1, 254.2, 254.7, 255, 780

See application file for complete search history.

(56) References Cited

U.S. PATENT DOCUMENTS

| | | | | |
|---|---|---|---|---|
| 3,679,085 | A | 7/1972 | Gach | |
| 3,776,407 | A | 12/1973 | Cistone | |
| 3,830,390 | A | 8/1974 | Gach | |
| 3,853,236 | A | 12/1974 | Ostrowsky | |
| 4,095,717 | A | 6/1978 | Michaelsen | |
| 4,353,474 | A | 10/1982 | Luker | |
| 4,433,789 | A | 2/1984 | Gibilisco | |
| 4,696,408 | A | 9/1987 | Dubach | |
| 4,832,218 | A | 5/1989 | Gibilisco | |
| 5,020,681 | A | 6/1991 | Kusz | |
| 5,316,161 | A | 5/1994 | Gargione | |
| 5,433,329 | A * | 7/1995 | Weinstein | 215/220 |
| 5,579,934 | A | 12/1996 | Buono | |
| 5,762,215 | A * | 6/1998 | Ogden | 215/220 |

(Continued)

FOREIGN PATENT DOCUMENTS

| | | | |
|---|---|---|---|
| GB | 2100238 | A | 12/1982 |
| GB | 2 187 177 | A | 9/1987 |

OTHER PUBLICATIONS

PCT Notification, Search Report and Written Opinion for PCT App: PCT/US2011/063084 Filed: Dec. 2, 2011 Date of Mailing: Feb. 6, 2012.

*Primary Examiner* — Robert J Hicks
*Assistant Examiner* — Kareen Rush
(74) *Attorney, Agent, or Firm* — Barnes & Thornburg LLP

(57) ABSTRACT

An inner shell for a child-resistant closure includes radial driven lugs extending in a radially outward direction from an inner skirt and extending axially along the inner skirt, radial abutments extending in a radially outward direction from the inner skirt and extending axially along the inner skirt adjacent to and spaced apart from the radial driven lugs in a counter-clockwise direction around the inner skirt, and pockets disposed between the radial driven lugs and the radial abutments. An outer shell for the closure includes radial driving lugs extending in a radially inward direction from an outer skirt.

45 Claims, 6 Drawing Sheets

(56) References Cited

U.S. PATENT DOCUMENTS

| | | | | |
|---|---|---|---|---|
| 7,111,746 | B2 | 9/2006 | Miceli et al. | |
| 7,401,707 | B2 | 7/2008 | Brozell et al. | |
| 7,815,061 | B1 * | 10/2010 | Robinson et al. | 215/220 |
| 8,109,396 | B1 * | 2/2012 | Robinson et al. | 215/220 |
| 8,186,526 | B2 * | 5/2012 | Branson et al. | 215/220 |
| 8,579,140 | B2 * | 11/2013 | Delagrange et al. | 220/254.5 |
| 2004/0045923 | A1 | 3/2004 | Lancesseur et al. | |
| 2004/0262251 | A1 | 12/2004 | Tauber | |
| 2008/0164234 | A1 | 7/2008 | Rho | |
| 2009/0032486 | A1 | 2/2009 | Brozell et al. | |

* cited by examiner

PUSH-AND-TURN CHILD-RESISTANT CLOSURE, SHELLS, AND PACKAGE

The present disclosure relates to push-and-turn child-resistant closures, shells for such closures, and packages that include such closures.

BACKGROUND AND SUMMARY OF THE DISCLOSURE

U.S. Pat. No. 5,020,681 discloses a child resistant closure including outer and inner nested closure members, each having a base wall on a peripheral skirt with sets of lugs on the inner surface of the outer closure member and on the outer surface of the inner closure member which are adapted to be engaged when the members are moved axially toward one another. The inner surface of the base wall of the outer closure member is formed with a plurality of integral spring fingers yieldingly urging the outer closure member away from the inner closure member. The outer surface of the base wall of the inner closure member is provided with a plurality of ramps and adjacent recesses. Each ramp includes a ramp surface extending axially outwardly from the outer surface of the base wall of the inner closure and has an abutment surface extending axially inwardly below the outer surface of the inner closure and is adapted to be engaged by the ends of the spring fingers. Each recess associated with an adjacent ramp includes an inclined surface extending axially inwardly from the outer surface of the inner closure member to the abutting surface of the ramp to form the recess. The ramps and recesses are constructed and arranged such that when the closure is rotated to apply the closure, the spring fingers engage the abutting surface and engage the recesses to orient the outer closure member and inner closure member such that the lugs on the outer closure member are aligned with the lugs on the inner closure member to prevent inadvertent engagement of the lugs by any top load. When the outer closure member is rotated relative to the inner closure member without bringing the lugs thereof into engagement, the spring fingers slip over the ramps and the recesses allowing the outer closure member to rotate with respect to the inner closure member. When the outer closure member is rotated relative to the inner closure member and moved axially relative to the inner closure member, the lugs are brought into engagement so that the closure can be removed from the container. Child-resistant closures of this type have been marketed for many years by applicants' assignee under the trademark CLIC-LOC. A general object of the present disclosure is to provide improvements in child-resistant closures of this type, and to provide shells for such improved closures and packages that include such improved closures.

The present disclosure embodies a number of aspects that can be implemented separately from or in combination with each other.

A child-resistant closure in accordance with one aspect of the disclosure includes an inner shell having an inner base wall with an inner skirt, external lugs on the inner base wall, at least one internal thread segment on the inner skirt, at least one ramp extending axially along an external surface of the inner skirt and radially outwardly from the inner skirt, and a detent on an outer periphery of the inner skirt extending axially along the inner skirt and radially outwardly from the inner skirt adjacent to the ramp and spaced from the ramp in a countercounterclockwise direction around the inner skirt. The closure also includes an outer shell having an outer base wall with an outer skirt surrounding the inner skirt of the inner shell, internal lugs on the outer base wall, and at least one flexible resilient spring finger extending radially inwardly at a counterclockwise angle from an inner periphery of the outer skirt. The spring finger engages the ramp from a clockwise direction to thread the inner shell onto a container neck finish, and the internal lugs overly the external lugs when the spring finger is resiliently removably captured between the ramp and the detent such that the lugs are positioned to support the outer shell on the inner shell.

In accordance with another aspect of the disclosure, there is provided an inner shell for a child-resistant closure that includes an inner base wall, an inner skirt extending in an axial direction from the inner base wall, and a plurality of axial driven lugs extending externally from the inner base wall in an axial direction opposite of the inner skirt. The inner shell also includes a plurality of radial driven lugs extending in a radially outward direction from the inner skirt and extending axially along the inner skirt, a plurality of radial abutments extending in a radially outward direction from the inner skirt and extending axially along the inner skirt adjacent to and spaced apart from the plurality of radial driven lugs in a counterclockwise direction around the inner skirt, and a plurality of pockets disposed between the radial driven lugs and the radial abutments.

In accordance with a further aspect of the disclosure, there is provided an outer shell for a child-resistant closure that includes an outer base wall, an outer skirt extending in an axial direction from the outer base wall, a plurality of axial driving lugs extending internally from the outer base wall in an axial direction the same as the outer skirt, and a plurality of radial driving lugs extending in a radially inward direction from the outer skirt.

In accordance with additional aspects of the disclosure, there are provided a closure including the inner and outer shells recited above, and a package including the above recited closures.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
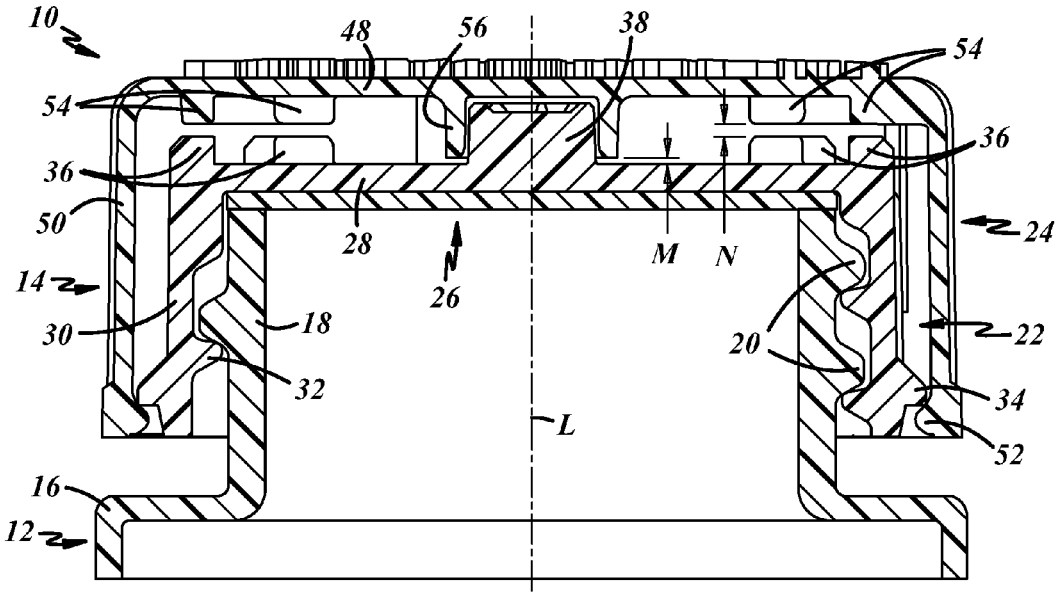
FIG. 1 is a fragmentary cross-sectional view of a package in accordance with an exemplary embodiment of the present disclosure.

FIG. 1 illustrates a child-resistant package 10 that includes a container 12, a child-resistant closure 14 coupled to the container 12, and a longitudinal axis L. The container 12 generally includes a body 16, and a neck finish 18 having one or more external thread segments 20 for coupling to the closure 14. As used herein, the term thread segment includes whole, partial, multiple, and/or an interrupted thread and/or thread segment. The closure 14 generally includes an inner shell 22 coupled to the neck finish 18 of the container 12, and an outer shell 24 coupled to the inner shell 22. The closure 14 also may include a liner 26 carried by the inner shell 22 for sealing engagement between the inner shell 22 and an axial end surface of the container neck finish 18. The closure 14 is rotatable about the longitudinal axis L for application to and removal from the container neck finish 18.

The inner shell 22 has a base wall 28 with an inner skirt 30 extending in a generally axial direction from a radially outward periphery of the base wall 28. The inner skirt 30 includes at least one internal thread segment 32 thereon for threaded coupling to the external thread segment(s) 20 of the container neck finish 18. The inner skirt 30 also includes at least one external shell retainer segment 34 so that the inner shell 22 can be nested and retained within the outer shell 24. The retainer segment 34 may be a single circumferentially continuous or interrupted element, or may include multiple circumferentially spaced apart elements.

Figure 2:
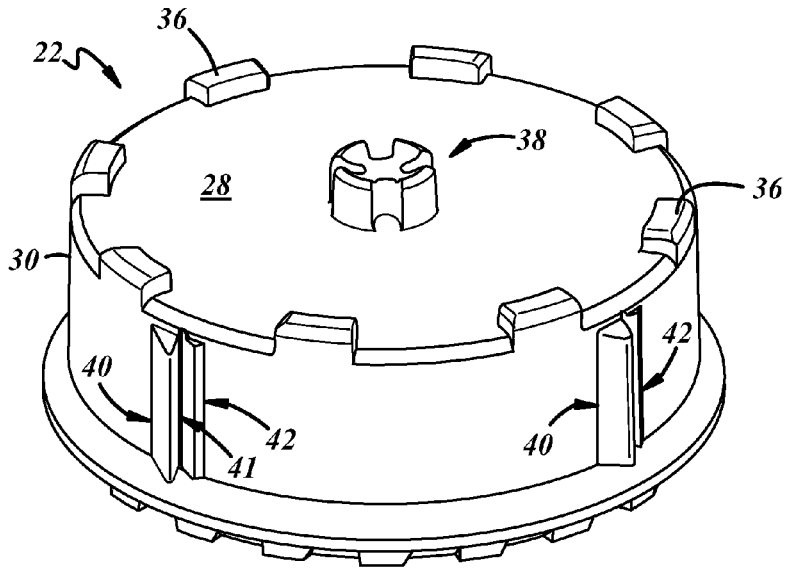
FIG. 2 is an exterior perspective view of an inner shell of a closure of the package of FIG. 1.
Figure 3:
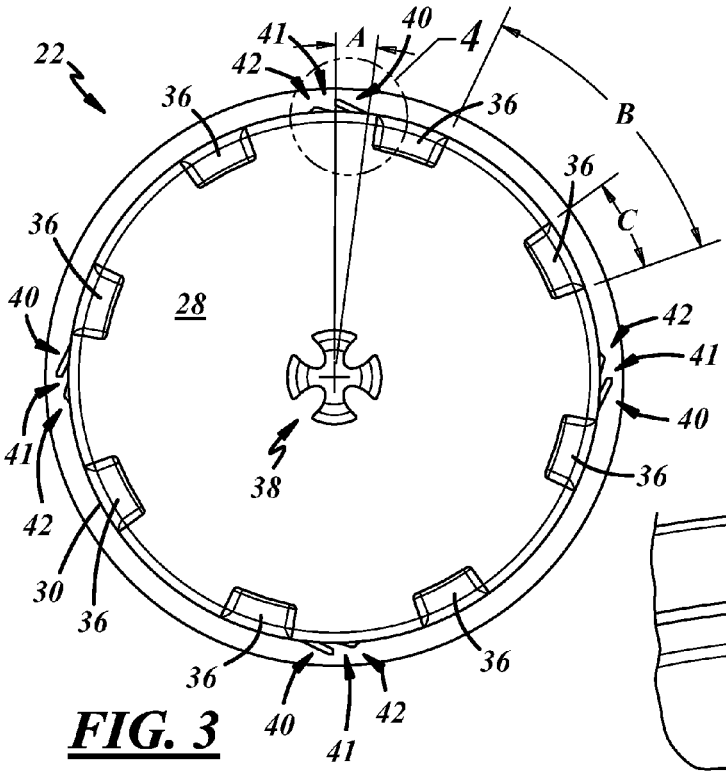
FIG. 3 is a top plan view of the inner shell of FIG. 2.

Referring to FIGS. 1-3, the base wall 28 includes a plurality of axial driven lugs 36 and an axially extending external center post 38. The lugs 36 and post 38 are external features that extend in a direction generally opposite that of the skirt 30. The driven lugs 36 are child-resistant features and may be circumferentially equally spaced apart. Although eight of the lugs 36 are illustrated, any suitable quantity and spacing of lugs 36 may be provided. The lugs 36 may be provided in an angularly spaced array at a radially outer periphery or peripheral edge of the base wall 28, for example, at an intersection of the base wall 28 and the skirt 30, as shown. The length of the center post 38 is greater than the length of the lugs 36. The center post 38 may be cross-shaped with a solid central portion, lobes, and pockets between the lobes, or may be of any other suitable shape. The center post 38 also may be dished wherein a length of radially outer portions of the lobes is greater than that of the solid central portion. The center post 38 may be solid, hollow, or of any other suitable shape and configuration.

As shown in FIGS. 2-3, the skirt 30 includes one or more first external radial projections 40 and one or more adjacent second external radial projections 42 extending axially along an external surface of the skirt 30 and radially outwardly from the skirt 30. The first radial projections 40 may be ramps or driven lugs, and the second radial projections 42 may be detents or abutments. The ramps 40 and detents 42 may be generally triangular-shaped in transverse cross section. The detents 42 are disposed adjacent to and spaced apart from the ramps 40 in a counterclockwise direction around the skirt 30. Accordingly, pockets 41 are provided circumferentially between the ramps 40 and the detents 42. The radial thickness of the ramp 40 is greater than that of the detent 42 or, stated another way, the outer diameter of the ramps 40 is greater than that of the detents 42.

As best shown in FIG. 3, the ramps 40 and detents 42 are circumferentially spaced in a counterclockwise direction from corresponding adjacent axial driven lugs 36, as indicated by angle A. In the illustrated embodiment, the angle A may be about ten degrees, the angular spacing B of adjacent lugs 36 may be about forty-five degrees, and the angular width C of each of the lugs 36 may be about fifteen degrees.

Figure 4:
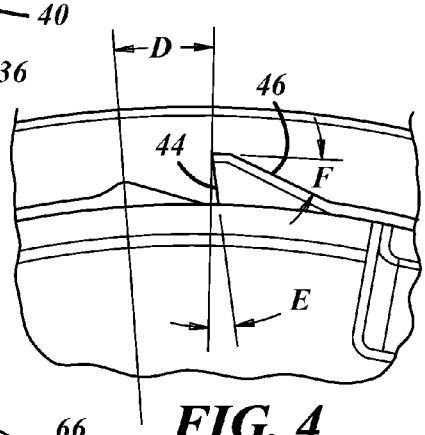
FIG. 4 is an enlarged fragmentary view of a portion of the inner shell of FIG. 2, taken from circle 4 of FIG. 3.

As best shown in FIG. 4, the ramps 40 and detents 42 may be circumferentially spaced as shown with a tip-to-tip angular spacing D of, for example, about four degrees. The ramps 40 may include counterclockwise oriented surfaces 44 that are disposed at a closed acute angle of less than ninety degrees with respect to the skirt 30 of the inner shell 22 or at a positive rake angle E of, for example, about ten degrees from a radial line. The ramps 40 also may include ramp surfaces 46 that are disposed at an angle of, for example, about twenty-five degrees from a tangential line perpendicular to the radial line.

Figure 5:
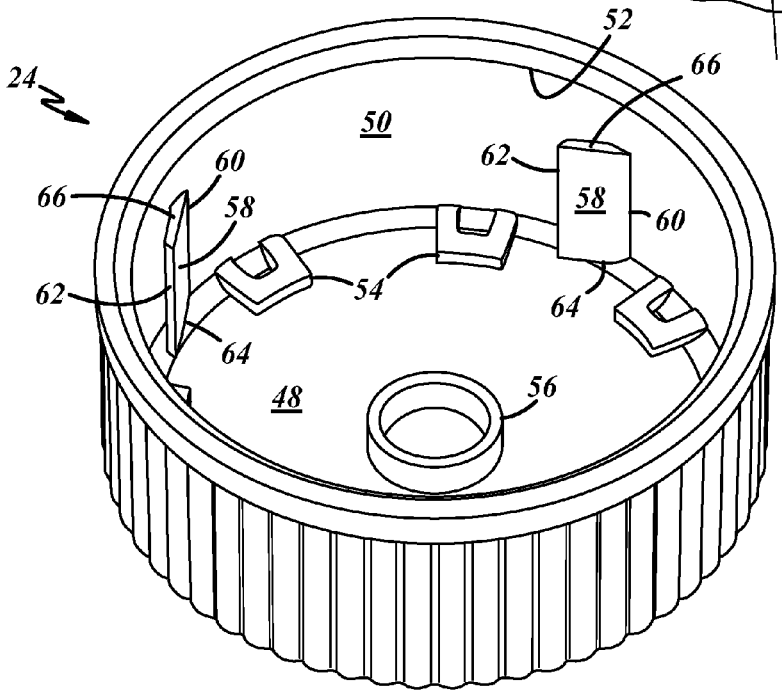
FIG. 5 is an interior perspective view of an outer shell of a closure of the package of FIG. 1.
Figure 6:
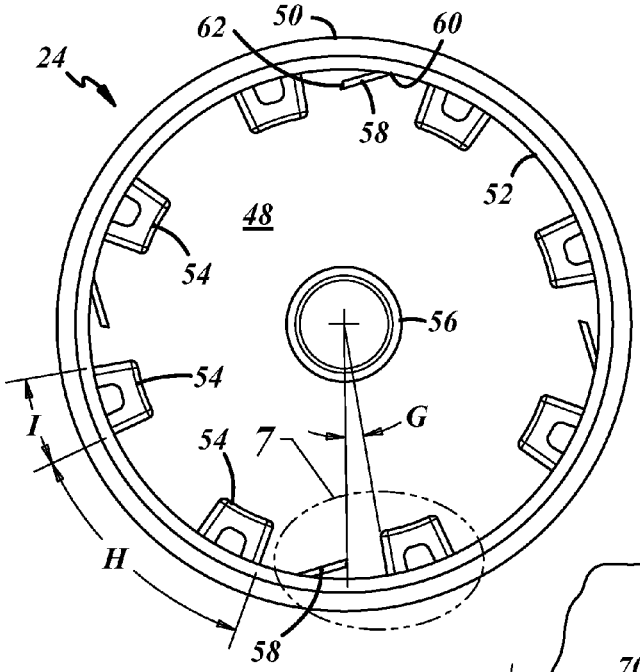
FIG. 6 is a bottom plan view of the outer shell of FIG. 5.

Referring to FIGS. 1, 5, and 6, the outer shell 24 has a base wall 48 with an outer skirt 50 extending in a generally axial direction from a radially outward periphery of the base wall 48, and surrounding the skirt 30 of the inner shell 22. The outer skirt 50 includes at least one internal shell retainer segment 52. The retainer segment 52 may be a single circumferentially continuous or interrupted element, or may include multiple spaced apart elements. The base wall 48 includes a plurality of axial drive lugs 54 and an axially extending internal center post 56 to receive the external center post 38 of the inner shell 22. The lugs 54 and post 56 are internal features that extend in a direction generally the same as that of the skirt 50. The drive lugs 54 are child-resistant features and may be circumferentially equally spaced apart. Although eight of the lugs 54 are illustrated, any suitable quantity and spacing of lugs 54 may be provided. The lugs 54 may be provided in an angularly spaced array at a radially outer periphery or peripheral edge of the base wall 48, for example, at an intersection of the base wall 48 and the skirt 50, as shown. The length of the center post 56 is greater than the length of the lugs 54. The center post 56 may be of hollow cylindrical shape, as shown.

Referring to FIGS. 5 and 6, the outer shell 24 also includes at least one internal radial projection 58 extending circumferentially and radially inwardly at an angle from an inner surface of the skirt 50. From a bottom view of the outer shell 24 as in FIGS. 5 and 6, the projection 58 extends in a clockwise direction. From a top view of the outer shell 24 as in FIG. 9, the projection 58 extends in a counterclockwise direction. As used herein, the terms "clockwise" and "counterclockwise" are taken from a top view of the shell(s) 22, 24, for example, from above as they would be applied to the container 12. The projection 58 is cantilevered from a circumferential fixed end 60 connected to the skirt 50, and has an opposite free end 62. As shown in the illustrated embodiment of FIG. 5, the projection 58 is connected to the base wall 48 at a fixed axial end 64 and has an opposite free axial end 66. But the projection 58 may be unconnected to the base wall 48 in another embodiment. The projection 58 may be a flexible resilient spring finger or radial drive lug.

As shown in FIG. 6, the projections or fingers 58 are circumferentially spaced in a counterclockwise direction from corresponding adjacent axial drive lugs 54, as indicated by angle G. In the illustrated embodiment, the angle G may be about ten degrees, the angular spacing H of adjacent lugs 54 may be about forty-five degrees, and the angular width I of each of the lugs 54 may be about fifteen degrees.

Figure 7:
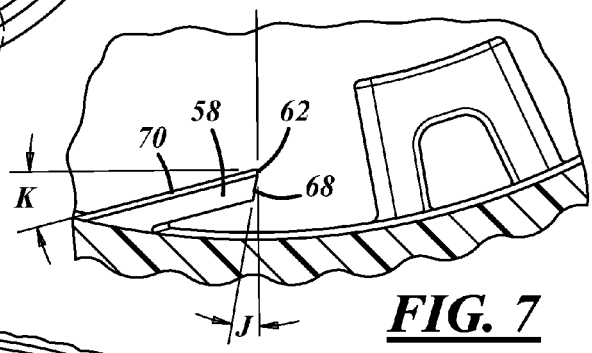
FIG. 7 is an enlarged fragmentary view of a portion of the outer shell of FIG. 5, taken from oval 7 of FIG. 6.

As best shown in FIG. 7, the free ends 62 of the fingers 58 have rake surfaces 68 that are disposed at a rake angle J of, for example, about ten degrees from a radial line, and ramp surfaces 70 that are disposed at an angle K of, for example, about fifteen degrees from a tangential line perpendicular to the radial line.

Figure 8:
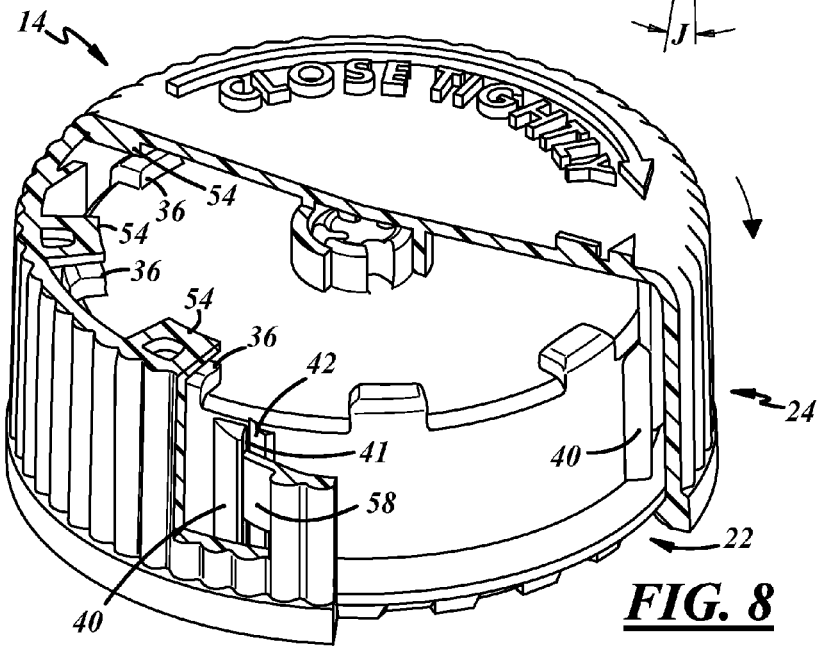
FIG. 8 is a fragmentary sectional view of a closure of the package of FIG. 1, illustrating the outer shell in a drive-on position with respect to the inner shell.
Figure 9:
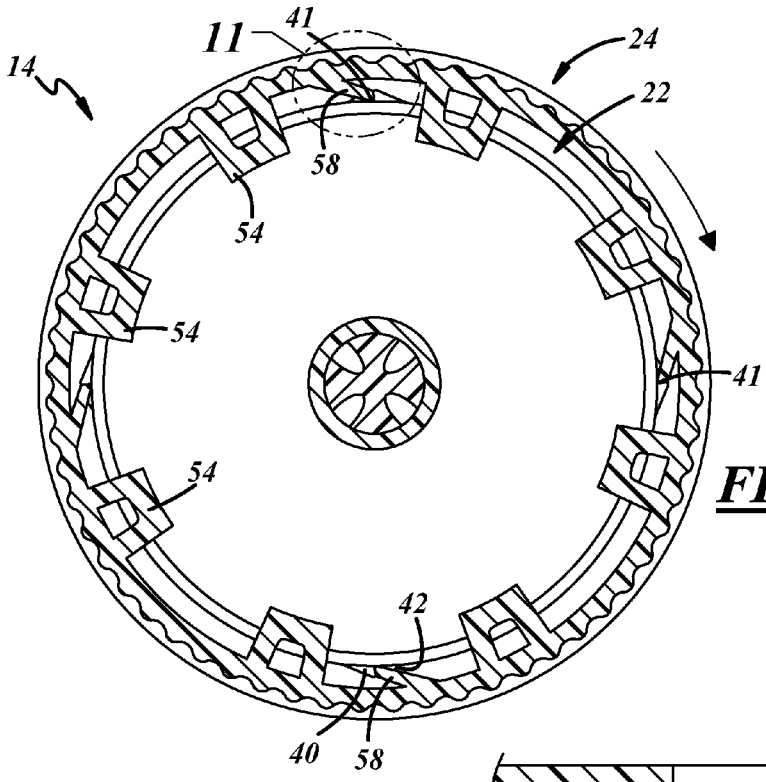
FIG. 9 is a cross-sectional top view of the closure of FIG. 8.

Referring now to FIGS. 8 and 9, the closure 14 is illustrated in a drive-on or stack condition. The outer shell 24 has been rotated relative to the inner shell 22 so that the spring fingers 58 drivingly engage the ramps 40 from a clockwise direction to thread the inner shell 22 onto the container neck finish 18 (FIG. 1). The spring fingers 58 are removably resiliently captured in the pockets 41 between the ramps 40 and the detents 422 so as to circumferentially align the axial drive lugs 54 with the axial driven lugs 36 (FIG. 8) to support the outer shell 24 on the inner shell 22.

Figure 10:
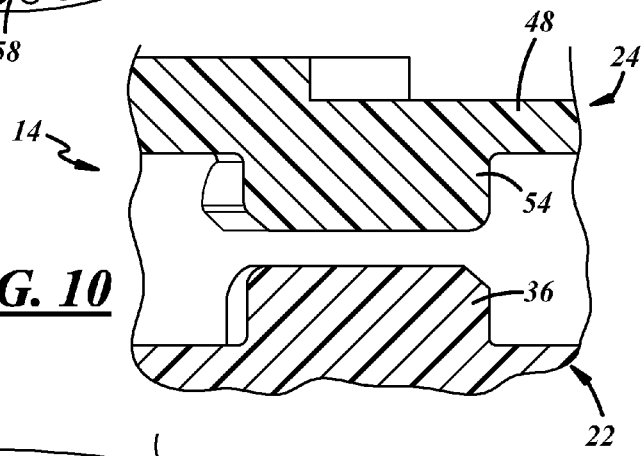
FIG. 10 is a fragmentary sectional view of the closure of FIG. 8, illustrating circumferentially aligned and disengaged child-resistant lugs.

As shown in FIG. 1, when the outer shell 24 is lifted relative to the inner shell 22 such that the retainers 34, 52 axially engage, there is an axial space M between the posts 38, 56 and corresponding opposite surfaces of the base walls 28, 48 and an axial space N between axially facing surfaces of the lugs 36, 54. To ensure axial operational clearance between the shells 22, 24, the axial space N is greater than the axial space M. As shown in FIG. 10, the axial lugs 36, 54 are circumferentially aligned or positioned to support the outer shell 24 on the inner shell 22, for example, during closure or package stacking to reduce or prevent stress on or permanent deformation of the base wall 48 of the outer shell 24.

Figure 11:
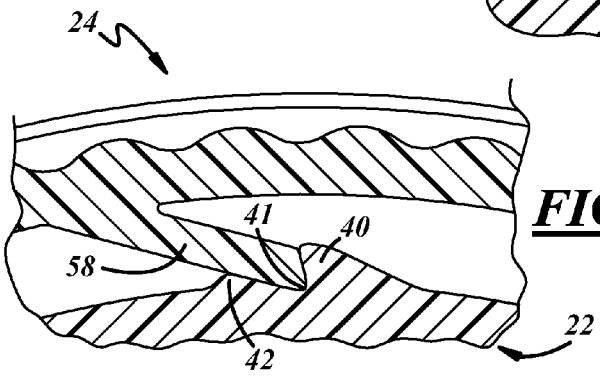
FIG. 11 is an enlarged fragmentary view of a portion of the closure of FIG. 8, taken from oval 11 of FIG. 9, illustrating a drive lug of the outer shell in a position of driving engagement with a ramp of the inner shell.
Figure 12:
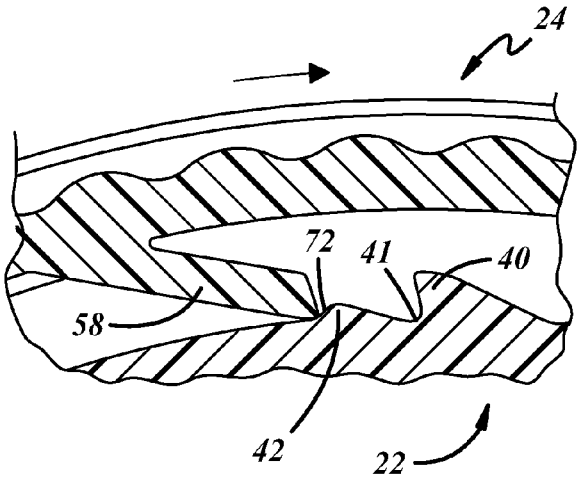
FIG. 12 is an enlarged fragmentary view similar to that of FIG. 11, illustrating the drive lug of the outer shell in a position of initial clockwise contact with a detent of the inner shell.
Figure 13:
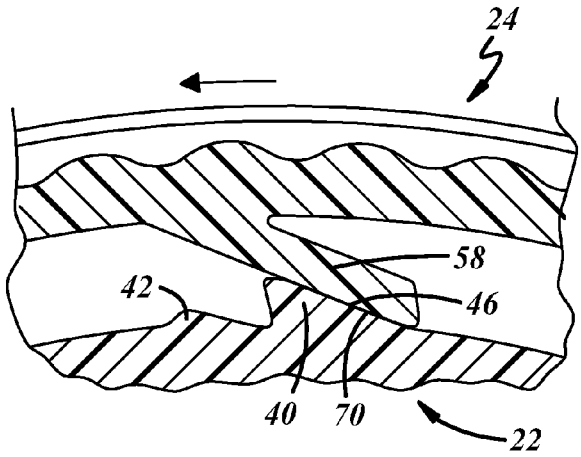
FIG. 13 is an enlarged fragmentary view similar to that of FIG. 11, illustrating the drive lug in a position of initial counterclockwise contact with the ramp of the inner shell.
Figure 14:
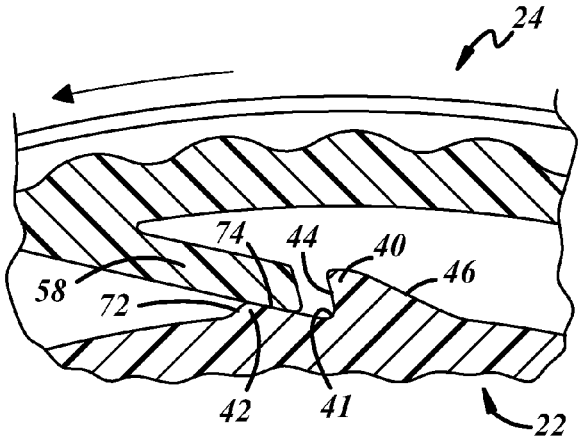
FIG. 14 is an enlarged fragmentary view similar to that of FIG. 11, illustrating the drive lug in initial counterclockwise contact with the detent of the inner shell.

FIGS. 11-14 illustrate various rotational or circumferential positions of the shells 22, 24 wherein the fingers 58 are in various rotational positions with respect to the sets of ramps 40 and detents 42. FIG. 11 illustrates one of the fingers 58 drivingly engaged to one of the ramps 40, and removably resiliently captured in one of the pockets 41 between one of the ramps 40 and one of the detents 42. FIG. 12 illustrates one of the fingers 58 in a position of initial clockwise contact with one of the detents 42 of the inner shell 24. The tip of the finger 58 contacts an angled surface 72 of the detent 42. FIG. 13 illustrates one of the fingers 58 in a position of initial counterclockwise contact with one of the ramps 40 of the inner shell 24. The ramp surface 70 of the finger 58 contacts the ramp surface 46 of the ramp 40. FIG. 14 is an enlarged fragmentary view similar to that of FIG. 11, illustrating one of the fingers 58 in initial counterclockwise contact with one of the detents 42 of the inner shell 24. In this latter position illustrated in FIG. 14, the finger 58 has snapped past the ramp 40 and flat against an angled surface 74 of the detent 40 to provide an audible click to indicate to a user that the outer shell 24 has not been pressed down against the inner shell 22 enough to engage the axial lugs 36, 54 for removal of the closure 14. The ramps 40 and detents 42 may be generally triangular-shaped in transverse cross section, and may be rounded with adjacent fillets and rounds. For example, rounds may be provided between the angled surfaces 72, 74 of the detents 42 and between the angled surfaces 44, 46 of the ramps 40. Also, fillets may be provided between the angled surface 72 and the adjacent external surface of the skirt 30 and between the ramp surface 46 and the adjacent external surface of the skirt 30, and the pocket 41 also may be filleted.

When the outer shell 24 is rotated in a counterclockwise direction relative to the inner shell 22 without bringing the axial lugs 36, 54 (FIG. 8) thereof into engagement, the fingers 58 slip over the ramps 40 and snap against the detents 42 to provide an audible click, but allow the outer shell 24 to rotate with respect to the inner shell 22. In addition to biasing the fingers 58 into the pockets 41, the detents 42 provide a means to produce a clicking sound that is greater than otherwise would be achievable without the detents 42. Also, the detents 42 tend to prevent the fingers 58 from bending backwards when the outer shell 24 is drivingly engaged to the inner shell 22. However, when the outer shell 24 is rotated in a counterclockwise direction relative to the inner shell 22 and moved axially relative toward the inner shell 22, the axial lugs 36, 54 (FIG. 8) are brought into driving engagement so that the closure 14 can be removed from a container.

Figure 15:
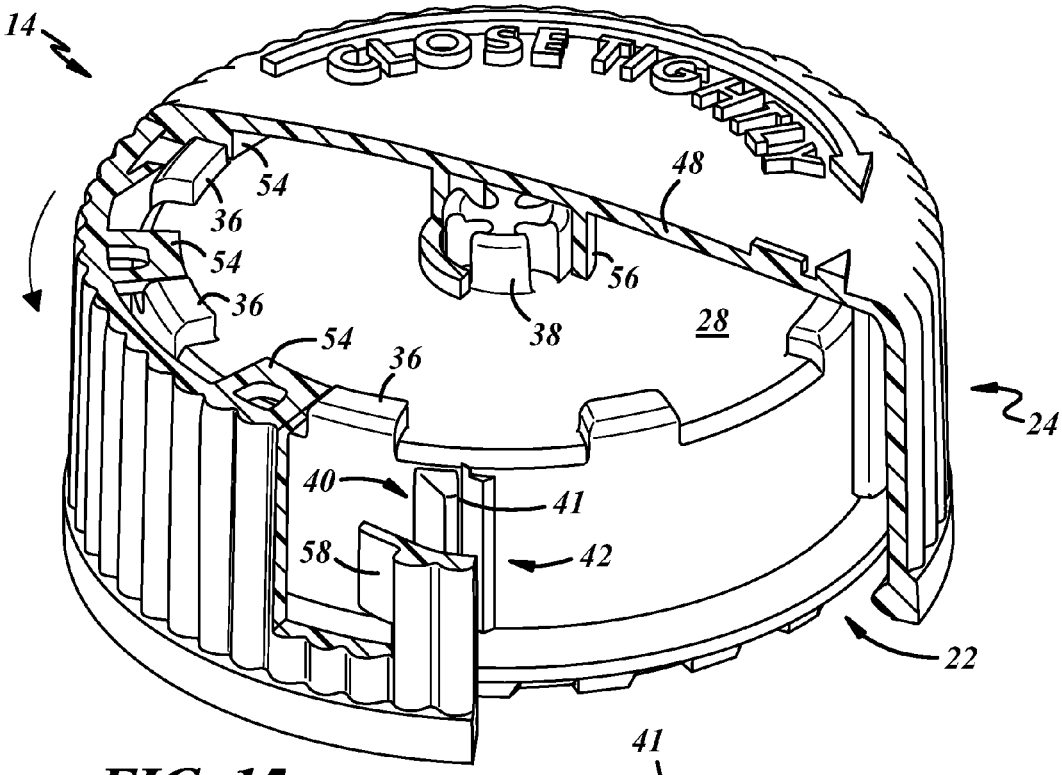
FIG. 15 is a fragmentary sectional view of the closure of the package of FIG. 1, illustrating the outer shell in a drive-off position with respect to the inner shell.
Figure 16:
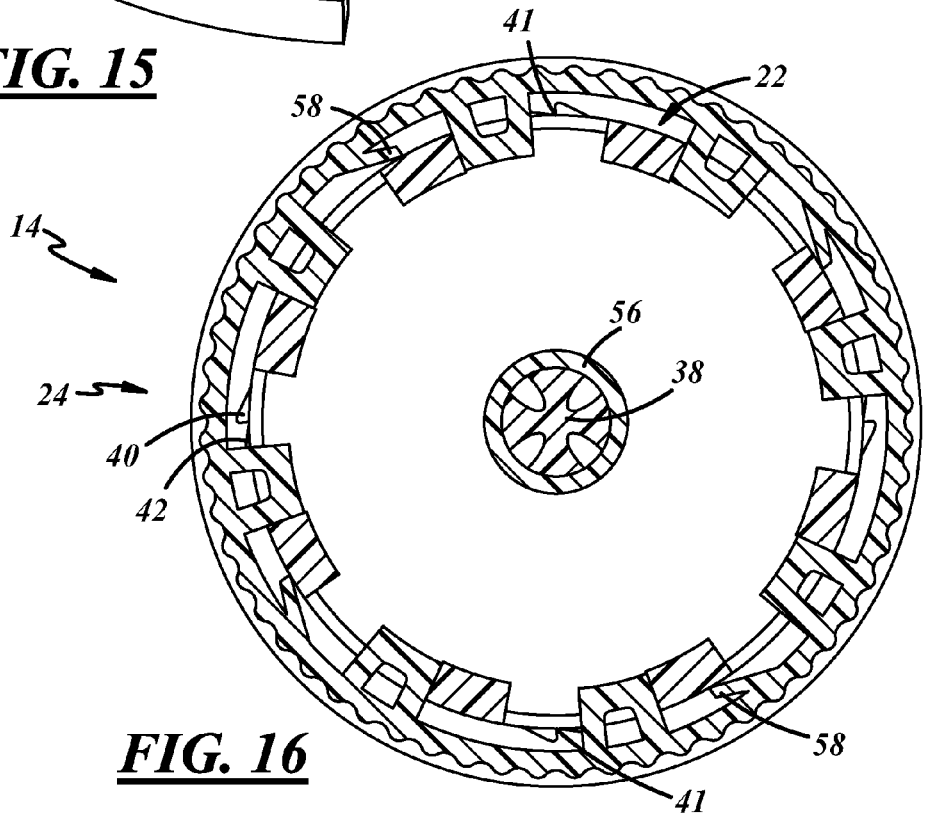
FIG. 16 is a cross-sectional view of the closure of FIG. 15, illustrating drivingly engaged child-resistant lugs.

Referring now to FIGS. 15 and 16, the closure 14 is illustrated in a drive-off condition. For example, the outer shell 24 has been rotated so as to disengage the fingers 58 from the pockets 41 between the ramps 40 and detents 42 so that the axial lugs 36, 54 no longer circumferentially overlap. Accordingly, as shown in FIG. 15, the outer shell 24 can be pressed down against the inner shell 22 so that the axial lugs 36, 54 overlap in an axial direction, and the outer shell 24 is rotated relative to the inner shell 22 so that corresponding circumferentially facing sides of the lugs 36, 54 engage so that the axial drive lugs 54 can drivingly engage the axial driven lugs 36 for closure removal. The center posts 38, 56 on the base walls 28, 48 of the inner and outer shells 22, 24 support the outer shell 24 with respect to the inner shell 22 such that resiliency of the base wall 48 of the outer shell 24 supplies a spring force that must be overcome to bring the lugs 36, 54 into engagement and unthread the inner shell 22 from the container neck finish 18 of FIG. 1. As shown in FIG. 1, the thickness of the base wall 48 of the outer shell 24 is relatively thinner than that of the base wall 28 of the inner shell 22.

The shells 22, 24 may be injection molded, compression molded, or produced in any other suitable manner and may be composed of polypropylene, high density polyethylene, or of any other suitable material. The shells 22, 24 may be pre-assembled to one another to establish the closure 14 before application to the container 12, or the inner shell 22 may be assembled to the container 12 and thereafter the outer shell 24 may be assembled to the inner shell 22.

The presently disclosed closure may provide one or more of the following advantages over prior closures: drive-on driving lugs that are stronger than those of prior closures, a detent configuration that ensures circumferential alignment of drive-off lugs for more robust stackability of the closure, drive-on driving lugs that are not additionally stressed when the closure is axially compressed, a drive-on configuration that does not require axial force to be applied to the closure, and an outer shell that can be strip molded.

There thus has been disclosed a child-resistant closure and package, that fully satisfies all of the objects and aims previously set forth. The disclosure has been presented in conjunction with several exemplary embodiments, and additional modifications and variations have been discussed. Other modifications and variations readily will suggest themselves to persons of ordinary skill in the art in view of the foregoing discussion. For example, The disclosure is intended to embrace all such modifications and variations as fall within the spirit and broad scope of the appended claims.

The invention claimed is:

1. A child-resistant closure that includes:

an inner shell having an inner base wall with an inner skirt, external lugs on said inner base wall, at least one internal thread segment on said inner skirt, at least one ramp extending axially along an external surface of said inner skirt and radially outwardly from said inner skirt, a detent on an outer periphery of said inner skirt extending axially along said inner skirt and radially outwardly from said inner skirt adjacent to said ramp and spaced from said ramp in a counterclockwise direction around said inner skirt, and a pocket disposed between said ramp and said detent, and an outer shell having an outer base wall with an outer skirt surrounding said outer skirt of said inner shell, internal lugs on said outer base wall, and at least one flexible resilient spring finger extending radially inwardly at an angle in a counterclockwise direction from an inner periphery of said outer skirt, said spring finger engaging said ramp from a clockwise direction to thread said inner shell onto a container neck finish, said internal lugs overlying said external lugs when said spring finger is resiliently removably captured between said ramp and said detent such that said lugs are positioned to support said outer shell on said inner shell.

2. The closure set forth in claim 1 wherein said ramp has a counterclockwise-oriented face at a closed acute angle of less than 90° with respect to said inner skirt of said inner shell.

3. A child-resistant closure that includes:

an inner shell having an inner base wall with an inner skirt, external lugs on said inner base wall, at least one internal thread segment on said inner skirt, at least one ramp extending axially along an external surface of said inner skirt and radially outwardly from said inner skirt, and a detent on an outer periphery of said inner skirt extending axially along said inner skirt and radially outwardly from said inner skirt adjacent to said ramp and spaced from said ramp in a counterclockwise direction around said inner skirt, and an outer shell having an outer base wall with an outer skirt surrounding said outer skirt of said inner shell, internal lugs on said outer base wall, and at least one flexible resilient spring finger extending radially inwardly at an angle in a counterclockwise direction from an inner periphery of said outer skirt, said spring finger engaging said ramp from a clockwise direction to thread said inner shell onto a container neck finish, said internal lugs overlying said external lugs when said spring finger is resiliently removably captured between said ramp and said detent such that said lugs are positioned to support said outer shell on said inner shell, wherein said external lugs are disposed in an angularly spaced array around an outer peripheral edge of said inner base wall of said inner skirt, said internal lugs are disposed in an angularly spaced array around an outer periphery of said outer base wall of said outer skirt, and center posts on said base walls of said inner and outer shells support said outer shell with respect to said inner shell such that resiliency of said outer base wall of said outer shell supplies a spring force that must be overcome to bring said lugs into engagement and unthread said inner shell from a container neck finish.

4. The closure set forth in claim 1 wherein said inner shell carries a liner and includes at least one internal thread segment on said inner skirt.

5. A child-resistant closure that includes:

an inner shell having an inner base wall with an inner skirt, external lugs on said inner base wall, at least one internal thread segment on said inner skirt, at least one ramp extending axially along an external surface of said inner skirt and radially outwardly from said inner skirt, and a detent on an outer periphery of said inner skirt extending axially along said inner skirt and radially outwardly from said inner skirt adjacent to said ramp and spaced from said ramp in a counterclockwise direction around said inner skirt, and an outer shell having an outer base wall with an outer skirt surrounding said outer skirt of said inner shell, internal lugs on said outer base wall, and at least one flexible resilient spring finger extending radially inwardly at an angle in a counterclockwise direction from an inner periphery of said outer skirt, said spring finger engaging said ramp from a clockwise direction to thread said inner shell onto a container neck finish, said internal lugs overlying said external lugs when said spring finger is resiliently removably captured between said ramp and said detent such that said lugs are positioned to support said outer shell on said inner shell, wherein said inner shell base wall includes an axially extending external center post and said outer shell base wall includes an axially extending internal center post to receive said external center post, wherein said external and internal center posts are longer than their corresponding external and internal lugs.

6. The closure set forth in claim 1 wherein said spring finger is cantilevered from a fixed end connected to said outer skirt and has an opposite free end.

7. The closure set forth in claim 6 wherein said spring finger has a fixed axial end connected to said outer shell base wall, and an opposite free axial end.

8. A child-resistant closure that includes:

an inner shell having an inner base wall with an inner skirt, external lugs on said inner base wall, at least one internal thread segment on said inner skirt, at least one ramp extending axially along an external surface of said inner skirt and radially outwardly from said inner skirt, and a detent on an outer periphery of said inner skirt extending axially along said inner skirt and radially outwardly from said inner skirt adjacent to said ramp and spaced from said ramp in a counterclockwise direction around said inner skirt, and an outer shell having an outer base wall with an outer skirt surrounding said outer skirt of said inner shell, internal lugs on said outer base wall, and at least one flexible resilient spring finger extending radially inwardly at an angle in a counterclockwise direction from an inner periphery of said outer skirt, said spring finger engaging said ramp from a clockwise direction to thread said inner shell onto a container neck finish, said internal lugs overlying said external lugs when said spring finger is resiliently removably captured between said ramp and said detent such that said lugs are positioned to support said outer shell on said inner shell, wherein said ramps and detents are generally triangular in cross-sectional shape, and include adjacent fillets and rounds.

9. A package including a container having said container neck finish and the closure set forth in claim 1 applied to said container neck finish.

10. An inner shell for a child-resistant closure that includes:
an inner base wall,
an inner skirt extending in an axial direction from said inner base wall,
a plurality of axial driven lugs extending externally from said inner base wall in an axial direction opposite of said inner skirt,
a plurality of radial driven lugs extending in a radially outward direction from said inner skirt and extending axially along said inner skirt,
a plurality of radial abutments extending in a radially outward direction from said inner skirt and extending axially along said inner skirt adjacent to and spaced apart from said plurality of radial driven lugs in a counterclockwise direction around said inner skirt, and
a plurality of pockets disposed between said radial driven lugs and said radial abutments.

11. The inner shell set forth in claim 10 wherein said radial driven lugs have counterclockwise-oriented faces at closed acute angles of less than 90° with respect to said inner skirt.

12. The inner shell set forth in claim 10 including at least one internal thread segment on said inner skirt and carrying a liner.

13. The inner shell set forth in claim 10 wherein said radial driven lugs and abutments are generally triangular in cross-sectional shape, and include adjacent fillets and rounds.

14. The inner shell set forth in claim 1 wherein pockets are disposed between said ramps and detents.

15. A closure including the inner shell set forth in claim 10.

16. The child-resistant closure recited in claim 10 and including the inner shell of claim 10 and also including:
an outer shell that includes:
an outer base wall,
an outer skirt extending in an axial direction from said outer base wall,
a plurality of axial driving lugs extending internally from said outer base wall in an axial direction the same as said outer skirt, and
a plurality of radial driving lugs extending in a radially inward direction from said outer skirt,
said axial driving lugs circumferentially overlying said axial driven lugs when said radial driving lugs are resiliently removably captured in said pockets between said radial driven lugs and said radial abutments such that said axial driving and driven lugs are positioned to support said outer shell on said inner shell,
when said outer shell is rotated in a clockwise direction, said radial driving lugs engaging said radial driven lugs from a clockwise direction to rotate said inner shell,
when said outer shell is rotated in a counterclockwise direction, said driving lugs slipping over said radial driven lugs and snapping against said radial abutments, until said outer shell is advanced toward said inner shell in an axial direction so as to engage said axial driving and driven lugs to rotate said inner shell.

17. The closure set forth in claim 16 wherein said external lugs are disposed in an angularly spaced array around an outer peripheral edge of said base wall of said inner skirt, said internal lugs are disposed in an angularly spaced array around an outer periphery of said base wall of said outer skirt, wherein said inner shell base wall includes an axially extending external center post and said outer shell base wall includes an axially extending internal center post to receive said external center post, wherein said external and internal center posts are longer than their corresponding external and internal lugs, and said center posts on said base walls of said inner and outer shells support said outer shell with respect to said inner shell such that resiliency of said base wall of said outer shell supplies a spring force that must be overcome to bring said lugs into engagement and unthread said inner shell from a container neck finish.

18. The closure set forth in claim 16 wherein said radial driving lug is cantilevered from a fixed end connected to said outer skirt and has an opposite free end.

19. The closure set forth in claim 18 wherein said radial driving lug has a fixed axial end connected to said outer shell base wall, and an opposite free axial end.

20. An outer shell for a child-resistant closure wherein the outer shell includes:
an outer base wall,
an outer skirt extending in an axial direction from said outer base wall,
a plurality of axial driving lugs extending internally from said outer base wall in an axial direction the same as said outer skirt, and
a plurality of radial driving lugs extending in a radially inward direction from said outer skirt and having fixed axial ends connected to said outer shell base wall, and axially opposite free axial ends.

21. The outer shell set forth in claim 20 wherein said radial driving lug is cantilevered from a fixed end connected to said outer skirt and has an opposite free end.

22. A child-resistant closure including:
an outer shell that includes
an outer base wall,
an outer skirt extending in an axial direction from said outer base wall,
a plurality of axial driving lugs extending internally from said outer base wall in an axial direction the same as said outer skirt, and
a plurality of radial driving lugs extending in a radially inward direction from said outer skirt; and
an inner shell that includes:
an inner base wall,
an inner skirt extending in an axial direction from said inner base wall,
a plurality of axial driven lugs extending externally from said inner base wall in an axial direction opposite of said inner skirt,
a plurality of radial driven lugs extending in a radially outward direction from said inner skirt and extending axially along said inner skirt,
a plurality of radial abutments extending in a radially outward direction from said inner skirt and extending axially along said inner skirt adjacent to and spaced apart from said plurality of radial driven lugs in a counterclockwise direction around said inner skirt, and
a plurality of pockets disposed between said radial driven lugs and said radial abutments,
said axial driving lugs circumferentially overlying said axial driven lugs when said radial driving lugs are resiliently removably captured in said pockets between said radial driven lugs and said radial abutments such that said axial driving and driven lugs are positioned to support said outer shell on said inner shell,
when said outer shell is rotated in a clockwise direction, said radial driving lugs engaging said radial driven lugs from a clockwise direction to rotate said inner shell,
when said outer shell is rotated in a counterclockwise direction, said driving lugs slipping over said radial driven lugs and snapping against said radial abutments, until said outer shell is advanced toward said inner shell in an axial direction so as to engage said axial driving and driven lugs to rotate said inner shell.

23. The closure set forth in claim 22 wherein at least one of said radial driven lugs has a counterclockwise-oriented face at a closed acute angle of less than 90° with respect to said inner skirt of said inner shell.

24. The closure set forth in claim 22 wherein said axial driven lugs are disposed in an angularly spaced array around an outer peripheral edge of said base wall of said inner skirt, said internal lugs are disposed in an angularly spaced array around an outer periphery of said base wall of said outer skirt, and center posts on said base walls of said inner and outer shells support said outer shell with respect to said inner shell such that resiliency of said base wall of said outer shell supplies a spring force that must be overcome to bring said axial driving and driven lugs into engagement and unthread said inner shell from a container neck finish.

25. The closure set forth in claim 22 wherein said inner shell carries a liner and includes at least one internal thread segment on said inner skirt.

26. The closure set forth in claim 22 wherein said inner shell base wall includes an axially extending external center post and said outer shell base wall includes an axially extending internal center post to receive said external center post, wherein said external and internal center posts are longer than their corresponding external and internal lugs.

27. The closure set forth in claim 22 wherein said spring finger is cantilevered from a fixed end connected to said outer skirt and has an opposite free end.

28. The closure set forth in claim 27 wherein said spring finger has a fixed axial end connected to said outer shell base wall, and an opposite free axial end.

29. The closure set forth in claim 22 wherein said radial driven lugs are generally triangular in cross-sectional shape, and include adjacent fillets and rounds.

30. The closure set forth in claim 22 wherein pockets are disposed between said radial driven lugs and detents.

31. A package including an external threaded neck finish and the closure set forth in claim 22 applied to said neck finish.

32. A child-resistant closure including an outer shell that includes:

an outer base wall, an outer skirt extending in an axial direction from said outer base wall, a plurality of axial driving lugs extending internally from said outer base wall in an axial direction the same as said outer skirt, and a plurality of radial driving lugs extending in a radially inward direction from said outer skirt; and an inner shell that includes:

an inner base wall, an inner skirt extending in an axial direction from said inner base wall, a plurality of axial driven lugs extending externally from said inner base wall in an axial direction opposite of said inner skirt, and a plurality of radial driven lugs extending in a radially outward direction from said inner skirt and extending axially along said inner skirt, wherein said inner shell base wall includes an axially extending external center post and said outer shell base wall includes an axially extending internal center post to receive said external center post, wherein said external center post is longer than said axial driven lugs of said inner shell and said internal center post is longer than said axial driving lugs of said outer shell, said center posts support said outer shell with respect to said inner shell such that resiliency of said base wall of said outer shell supplies a spring force that must be overcome to bring said axial driving and driven lugs into engagement.

33. The closure set forth in claim 32 wherein said radial driving lug is cantilevered from a fixed end connected to said outer skirt and has an opposite free end.

34. The closure set forth in claim 33 wherein said radial driving lug has a fixed axial end connected to said outer shell base wall, and an opposite free axial end.

35. The closure of claim 32 wherein said inner shell also includes a plurality of radial abutments extending in a radially outward direction from said inner skirt and extending axially along said inner skirt adjacent to and spaced apart from said plurality of radial driven lugs in a counterclockwise direction around said inner skirt, and a plurality of pockets disposed between said radial driven lugs and said radial abutments, said axial driving lugs circumferentially overlying said axial driven lugs when said radial driving lugs are resiliently removably captured in said pockets between said radial driven lugs and said radial abutments such that said axial driving and driven lugs are positioned to support said outer shell on said inner shell, when said outer shell is rotated in a clockwise direction, said radial driving lugs engaging said radial driven lugs from a clockwise direction to rotate said inner shell, when said outer shell is rotated in a counterclockwise direction, said driving lugs slipping over said radial driven lugs and snapping against said radial abutments, until said outer shell is advanced toward said inner shell in an axial direction so as to engage said axial driving and driven lugs to rotate said inner shell.

36. The closure set forth in claim 35 wherein said driven lugs have counterclockwise-oriented faces at closed acute angles of less than 90° with respect to said inner skirt of said inner shell.

37. The closure set forth in claim 35 wherein said axial driven lugs are disposed in an angularly spaced array around an outer peripheral edge of said base wall of said inner skirt, said axial driving lugs are disposed in an angularly spaced array around an outer periphery of said base wall of said outer skirt.

38. The closure set forth in claim 35 wherein said inner shell carries a liner and includes at least one internal thread segment on said inner skirt.

39. The closure set forth in claim 35 wherein said driven lugs and said abutments are generally triangular in cross-sectional shape, and include adjacent fillets and rounds.

40. A package including an external threaded neck finish and the closure set forth in claim 32 applied to said neck finish.

41. The closure set forth in claim 32 wherein said internal center post is of hollow cylindrical shape.

42. The closure set forth in claim 32 wherein said base wall of said outer shell is thinner than said base wall of said inner shell.

43. A child-resistant closure that includes:

an inner shell having an inner base wall with an inner skirt, external lugs on said inner base wall, at least one internal thread segment on said inner skirt, at least one ramp extending axially along an external surface of said inner skirt and radially outwardly from said inner skirt, and an outer shell having an outer base wall with an outer skirt surrounding said outer skirt of said inner shell, internal lugs on said outer base wall, and at least one flexible resilient spring finger extending radially inwardly at an angle in a counterclockwise direction from an inner periphery of said outer skirt, said spring finger engaging said ramp from a clockwise direction to thread said inner shell onto a container neck finish, said internal lugs overlying said external lugs when said spring finger is located against said ramp such that said lugs are positioned to support said outer shell on said inner shell.

44. The closure set forth in claim 43 wherein the inner shell and the outer shell include cooperating features that engage one another to orient the outer and inner shells such that the internal lugs on the outer shell are circumferentially aligned with and disengaged from the external lugs on the inner shell to prevent inadvertent engagement of the internal and external lugs by a top load.

45. The closure set forth in claim 44 wherein the cooperating features include the spring fingers removably resiliently captured in pockets between the ramps and detents adjacent the ramps.

* * * * *